US006175286B1

(12) United States Patent
Ueno

(10) Patent No.: US 6,175,286 B1
(45) Date of Patent: Jan. 16, 2001

(54) DIELECTRIC RESONATOR AND DIELECTRIC FILTER USING THE SAME

(75) Inventor: Moriaki Ueno, Fukushima-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/286,863

(22) Filed: Apr. 6, 1999

(30) Foreign Application Priority Data

Apr. 6, 1998 (JP) ..... 10-093703

(51) Int. Cl.[7] ..... H01P 7/10; H01P 1/20
(52) U.S. Cl. ..... 333/219.1; 333/202
(58) Field of Search ..... 333/219.1, 202

(56) References Cited

U.S. PATENT DOCUMENTS 4,686,496 * 8/1987 Syrett et al. ..... 333/202
4,942,377 * 7/1990 Ishikawa et al. ..... 333/219.1
5,008,640 * 4/1991 Accatino et al. ..... 333/219.1
5,457,087 * 10/1995 Dorothy et al. ..... 333/219.1
5,680,080 10/1997 Nishiyama et al. .
5,831,496 11/1998 Sonoda et al. .
6,052,041 * 4/2000 Ishikawa et al. ..... 333/202

* cited by examiner

*Primary Examiner*—Robert Pascal
*Assistant Examiner*—Patricia T. Nguyen
(74) *Attorney, Agent, or Firm*—Brinks Hofer Gilson & Lione

(57) ABSTRACT

A dielectric resonator which is not easily influenced by vibration and can stably obtain excellent performance is disclosed. A dielectric resonator comprises an exciting means in which a pillar-shaped dielectric block housed in a conductive casing in a state where the block is electrically connected to the casing and which produces a magnetic field on the plane perpendicularly crossing the axial direction of the dielectric block through which a current is passed, wherein the exciting means is comprised of a supporting member fixed to the casing and electrode patterns each of which is connected to an input terminal or an output terminal and is formed on the supporting member

5 Claims, 8 Drawing Sheets

DIELECTRIC RESONATOR AND DIELECTRIC FILTER USING THE SAME

BACKGROUND OF THE INVENTION

1. Field of the Invention

The present invention relates to a dielectric resonator and a dielectric filter suitable for use in an electronic device such as a shared device of transmission and reception signals (duplexer) for a cellular base station.

2. Description of the Related Art

As shown in FIG. 9, generally, a conventional dielectric resonator is constructed in such a manner that a cylindrical dielectric block 100 made of ceramics is fixed on the bottom of a metal casing body 101 and the opening of the metal casing body 101 is covered with a casing lid 101*a* for keeping an electromagnetic field energy inside.

An input connector 102 is attached to, for example, the left-side wall of the metal casing body 101 and an output connector 103 is attached to the right-side wall. The front ends of central conductors 102*a* and 103*a* of the input and output connectors 102 and 103 penetrate the left-side and right-side walls, respectively, and are projected to the inside of the metal casing body 101. One ends of coil-shaped coupling loops 104 and 105 are soldered to the front ends of the central conductors 102*a* and 103*a*, respectively. The other ends of the coupling loops 104 and 105 are fixedly soldered to the metal casing body 101 and connected to the ground.

According to another conventional example, as shown in FIG. 10, one ends of almost linear probes 114 and 115 are connected to the central conductors of input and output connectors 112 and 113, respectively, which project to the inside of a metal casing 111, the probes 114 and 115 are arranged along the internal circumferencial wall of the metal casing 111, and the other ends are disposed near the dielectric block 100.

In a dielectric resonator having such a construction, the coupling loops 104 and 105 or the probes 114 and 115 are magnetically coupled to the dielectric block 100. When an electric signal is supplied to the coupling loop 104 or the probe 114, a magnetic field is produced in the coupling loop 104 or the probe 114. By the magnetic energy, the dielectric block 100 is excited, a current is passed through the dielectric block 100, and a magnetic field is produced. By the magnetic energy, a magnetic field is generated, a current is passed through the coupling loop 105 or the probe 115 on the output side, and an electric signal is outputted from the output side connector 103 or 113.

In a conventional dielectric resonator as described above, the coupling loops 104 and 105 or the probes 114 and 115 a re not structurally resistant to vibration. When the dielectric resonator is subjected to vibration, the coupling loops 104 and 105 or the probes 114 and 115 vibrate more than the dielectric resonator 100. Consequently, there is an inconvenience such that the degree of coupling to the dielectric block 100 changes.

In order to deal with it, a method of fixing the coupling loops 104 and 105 or the probes 114 and 115 so as not to vibrate by using an adhesive such as paraffin can be considered. However, a problem such that deterioration in performance occurs due to the application of the adhesive arises.

SUMMARY OF THE INVENTION

It is therefore an object of the invention to provide a dielectric resonator which is not easily influenced by vibration and can have excellent performance stably.

In order to solve the problems, a dielectric resonator of the invention comprises exciting means in which a pillar-shaped dielectric block is housed in a conductive casing in a state where the dielectric block is electrically connected to the casing and which produces a magnetic field on a plane perpendicularly crossing the axial direction of the dielectric block through which a current is passed, wherein the exciting means includes a supporting member which is fixed to the casing and at least one electrode pattern which is connected to an input or output terminal and formed on the supporting member.

Since the exciting means is fixed to the casing, the dielectric resonator of the invention is not easily influenced by vibration, so that stable performance can be obtained.

It is preferable that the supporting member is made of a dielectric and an electrode pattern made of a conductive material is formed on the supporting member, so that the physical dimension of the exciting means can be reduced by shortening the wavelength of the dielectric. As a dielectric, plastics such as Teflon or epoxy resin and ceramics are desirable. From the viewpoint of the effects produced by shortening the wavelength, a dielectric of ceramics having a high dielectric constant is the most preferred. By disposing such a supporting member in the casing, the magnetic energy is radiated effectively in the conductive casing. Consequently, the dielectric block can be efficiently excited.

It is preferable to construct in such a manner that the electrode pattern is constructed by two electrode patterns sandwiching the supporting member, one of the electrode patterns is connected to an input terminal or an output terminal, and the other electrode pattern is connected to the ground. By forming the two electrode patterns in a shape having opposed parts over the supporting member, a dielectric resonator having sharp attenuation characteristics in which there are attenuation regions on both sides of a pass band frequency region can be obtained.

A configuration such that a supporting member is made of a dielectric, an electrode pattern formed on the supporting member has the shape comprising two electrode bands which are spaced in parallel and a coupling band which couples one ends on the same side of the two electrode bands, and the input and output terminals are connected to the electrode pattern can be also employed.

For example, when a coupling band formed in an almost U shape on the top face of the supporting member and two electrode bands which are continued from both ends of the coupling band and spaced in parallel on one side face which faces the dielectric block are formed, a strong magnetic field can be produced near the dielectric block.

When a coupling band linearly formed on the top face of the supporting member and two electrode bands which are continued from both ends of the coupling band and formed on opposed two side faces are formed, a strong magnetic field can be produced by the electrode bands.

By using the dielectric resonator of the invention as input and output units of a dielectric filter, a dielectric filter which is not easily influenced by vibration and has excellent stability can be obtained.

DETAILED DESCRIPTION OF THE PREFERRED EMBODIMENTS

Figure 1:
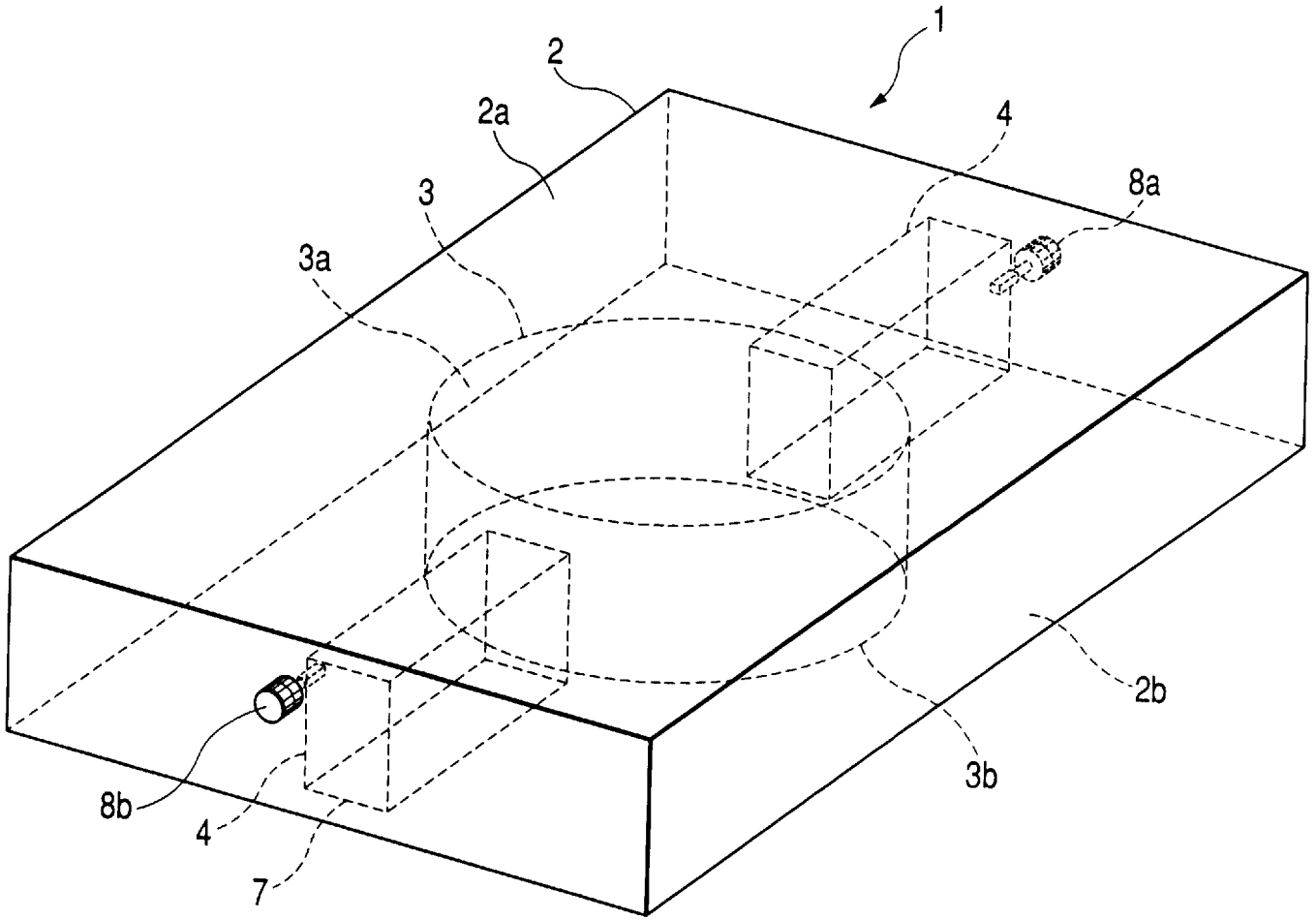
FIG. 1 is a perspective view showing a first embodiment of a dielectric resonator of the invention.
Figure 2:
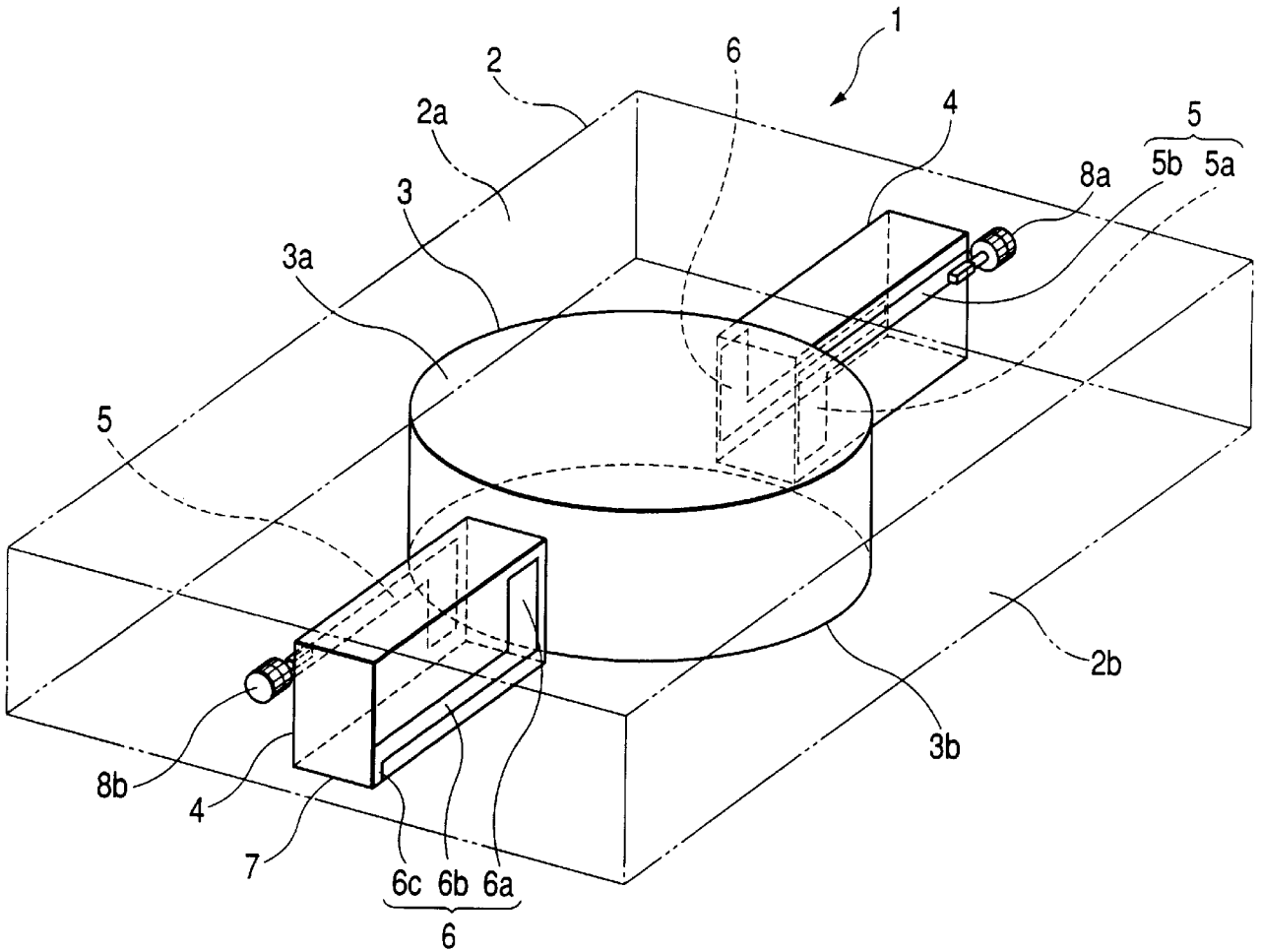
FIG. 2 is a perspective view of the dielectric resonator of the first embodiment of the invention.
Figure 3:
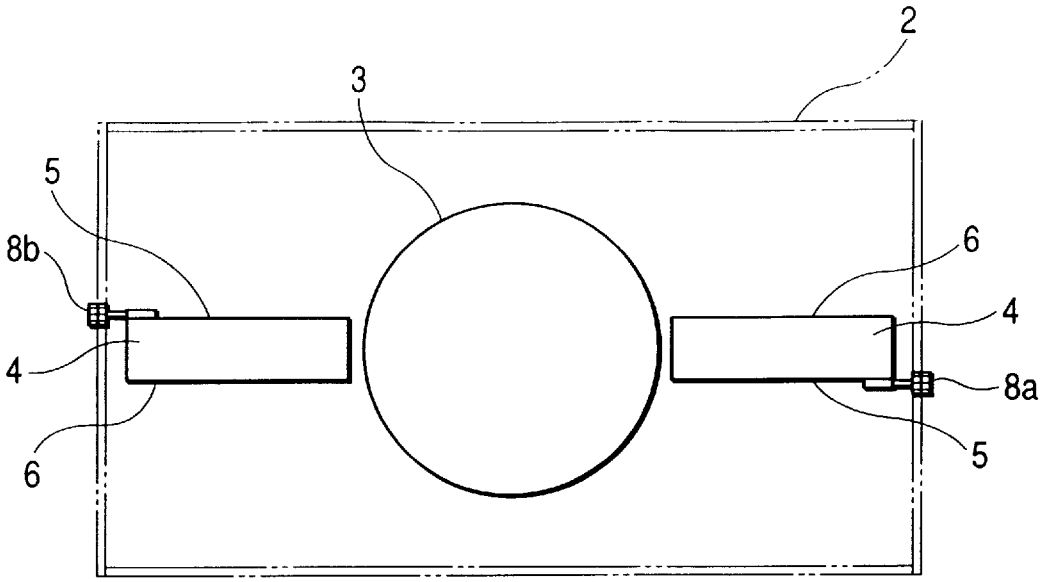
FIG. 3 is a plan view of the dielectric resonator of the first embodiment of the invention.

The present invention will be described in detail hereinbelow. FIGS. 1 to 3 show a first embodiment of a dielectric resonator of the invention. FIGS. 1 and 2 are perspective views and FIG. 3 is a plan view when the dielectric resonator is seen from overhead. In the following drawings, there is a case only outlines of components are shown so that the arrangement of each component can be known.

Generally, a dielectric resonator 1 of the embodiment is constructed in such a manner that a dielectric block 3 and two supporting members 4 and 4 are housed in a casing 2The The casing 2 is made of a conductive material such as copper and formed in a box shape.

The dielectric block 3 is made of ceramics using a dielectric material such as $BaO—TiO_2—Nd_2O_3$ and formed in a cylindrical shape. On the top and bottom faces of the dielectric block 3, an upper end electrode 3*a* and a lower end electrode 3*b* are formed, respectively, for example, by applying and sintering a conductive paste.

The upper and lower end electrodes 3*a* and 3*b* of the dielectric block 3 are electrically connected and adhered to the inner faces of the top plate 2*a* and the bottom plate 2*b* of the casing 2, respectively, by using a cream solder or a conductive paste.

Each of the supporting members 4 is made of the same material such as dielectric ceramics as that of the dielectric block 3 and formed in a prismatic shape. A first electrode pattern 5 and a second electrode pattern 6 are formed on a set of opposite side faces and a bottom face electrode 7 is formed on the whole bottom face. The first and second electrode patterns 5 and 6 and the bottom face electrode 7 are made of a conductive material such as Cu or Ag and formed in a film state on the faces of the supporting member 4. The first electrode pattern 5 is formed in an almost L-letter shape having: a vertical side part 5*a* formed along the side extending from the top face to the bottom face of the supporting member 4 among the four sides forming a side face of the supporting member 4; and a lateral side part 5*b* formed along the side serving as the boundary between the side face and the top face of the supporting member 4. One end of the lateral side part 5*b* is continued from the vertical side part 5*a* and the other end is open. The second electrode pattern 6 is formed in an almost L-letter shape having: a vertical side part 6*a* formed along the side extending from the top face to the bottom face among four sides forming a side face of the supporting member 4; a lateral side part 6*b* formed along the side serving as the boundary between the side face and the bottom face; and a coupling part 6*c* for coupling the lateral side part 6*b* and the bottom face electrode 7. The first and second electrode patterns 5 and 6 are so constructed that at least a part of the vertical side part 5*a* and a part of the vertical side part 6*a* are opposed to each other over the supporting member 4.

The first and second electrode patterns 5 and 6 and the bottom face electrode 7 can be formed, for example, by etching or the like as necessary after plating an electrode material on the faces of the supporting member 4 on which those electrodes are to be formed. Alternatively, the electrode patterns 5 and 6 having desired shapes may be formed by sputtering.

The bottom face of the supporting member 4 is fixedly adhered to the inner face of the bottom plate 2*b* of the casing 2 by using a cream solder or a conductive paste, and the bottom face electrode 7 is connected to the ground. The vertical side parts 5*a* and 6*a* of the first and second electrode patterns 5 and 6 are positioned near the dielectric block 3 and arranged so as to be in parallel to the axial direction of the dielectric block 3.

Further, an input terminal 8*a* and an output terminal 8*b* are connected near the open ends of the first and second electrode patterns 5 and 5 formed on the two supporting members 4 and 4.

In the dielectric resonator 1 having a such construction, exciting means is comprised of the supporting member 4, and the electrode patterns 5 and 6, and the bottom electrode 7 which are formed on the faces of the supporting member 4. More specifically, the vertical side part 5*a* of the first electrode pattern 5 and the vertical side part 6*a* of the second electrode pattern 6 are opposed to each other over the supporting member 4 made of a dielectric material. When an electric signal is inputted from the input terminal 8*a*, a current is passed through the vertical side parts 5*a* and 6*a* of the first and second electrode patterns 5 and 6 and a magnetic field is produced on the plane which perpendicularly crosses the axial direction of the dielectric block 3. The dielectric block 3 is excited by the magnetic energy, a current flows through the dielectric block 3 and the conductive casing 2, and a magnetic field is produced. By the magnetic energy, a magnetic field is produced by the exciting means on the output side, the current flows through the vertical side parts 5*a* and 6*a* of the first and second electrode patterns 5 and 6, and an electric signal is outputted from the output terminal 8*b*. The lateral side parts 5*b* and 6*b* of the first and second electrode patterns 5 and 6 formed on the supporting member 4 form distributed constant lines and a resonance frequency changes according to the length of the parts.

Figure 4:
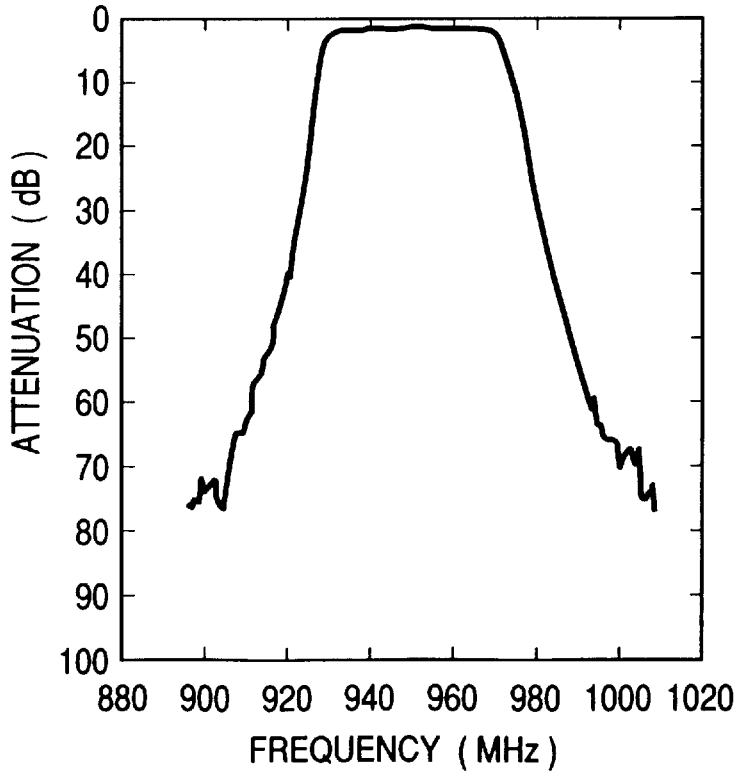
FIG. 4 is a graph showing attenuation characteristics of the dielectric resonator of the first embodiment of the invention.

FIG. 4 shows attenuation characteristics of the dielectric resonator of the embodiment. As shown in FIG. 4, the dielectric resonator 1 of the embodiment has attenuation regions on both sides of a pass band frequency region and sharp attenuation characteristics are obtained. Since the exciting means is comprised of the block-shaped supporting member 4, and the electrode patterns 5 and 6 and the bottom face electrode 7 which are formed on the faces of the supporting member 4, and the supporting member 4 is fixedly adhered inside the conductive casing 2, the dielectric resonator is not easily influenced by vibration, so that excellent performance can be stably obtained.

Further, since the exciting means is obtained by forming the electrodes on the supporting member 4 made of a material having a high dielectric constant, the physical dimension of the exciting means can be reduced by shortening the wavelength of the dielectric. Since the exciting means is used at about the resonance frequency, a large magnetic field can be generated.

In the dielectric resonator of the embodiment, the two supporting members 4 and 4 are so arranged as to be symmetrical with respect to the dielectric block 3. The invention is not limited to the arrangement. It is sufficient to arrange the supporting members 4 and4 so that the magnetic field is produced on the plane which perpendicularly crosses the axial direction of the dielectric block 3 when a current is passed through the first and second electrode patterns 5 and 6. That is, the supporting members 4 and 4 can be arranged so that the length direction of the top and bottom faces is the same as the direction of the radius of the top and bottom faces of the dielectric block 3. The supporting members 4 and 4 have to keep a distance from each other to prevent the magnetic fields generating around them from cancelling each other out.

The dielectric resonator 1 of the embodiment can be also used as an input/output unit of a dielectric filter. To be specific, a plurality of dielectric blocks 3 each housed in the conductive casing are so arranged as to electromagnetically connected to each other and the exciting means each comprised of the supporting member 4 and the electrode patterns 5 and 6, and the bottom electrode 7 which are formed on the faces of the supporting member 4 are provided on both ends. Since the dielectric resonator 1 of the embodiment can obtain sharp attenuation characteristics as shown in FIG. 4, when a dielectric filter is constructed by using it, a high-performance band-pass filter which is vibration-resistant and has excellent attenuation characteristics can be obtained.

Figure 5:
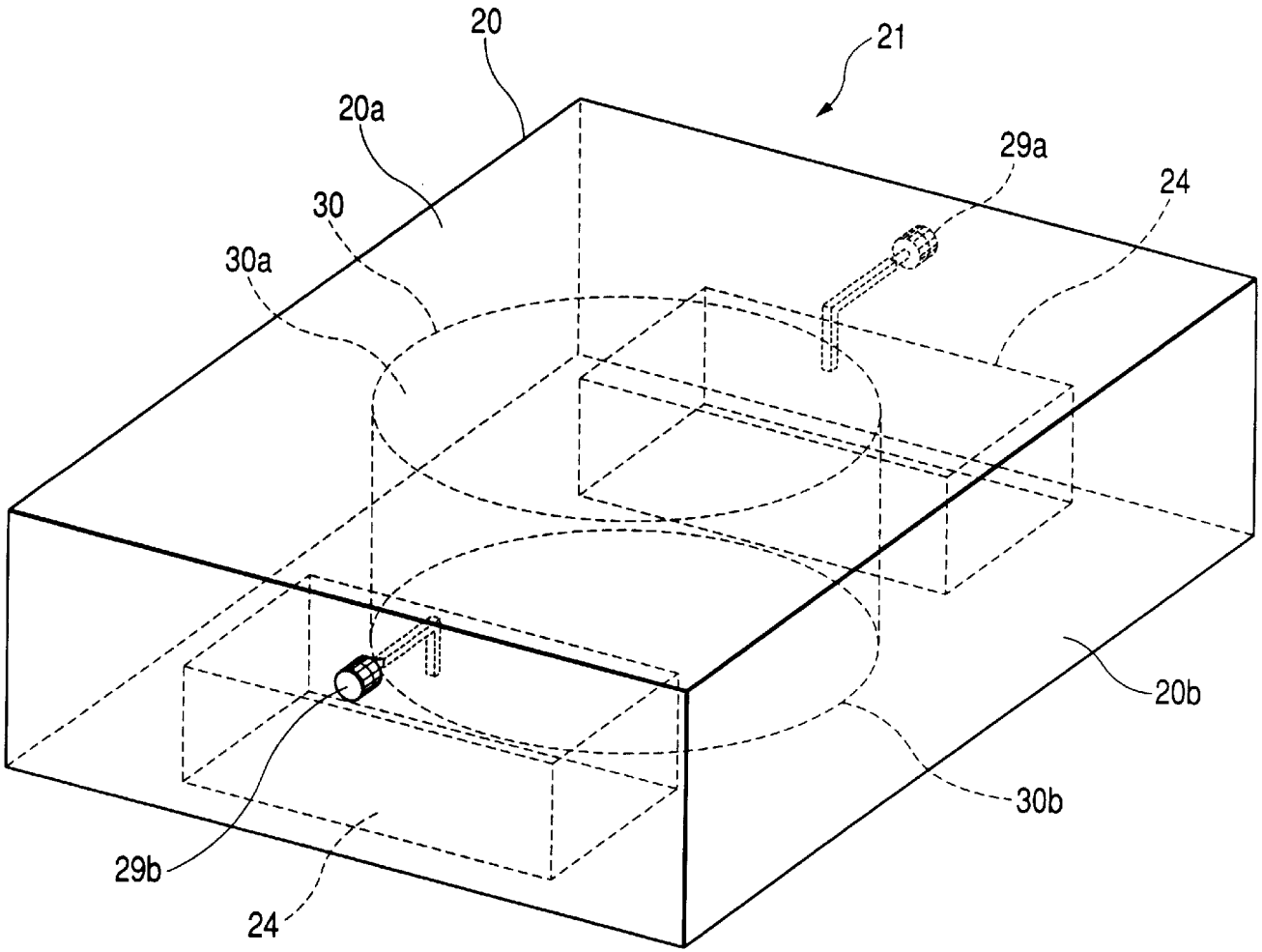
FIG. 5 is a perspective view showing a second embodiment of the dielectric resonator of the invention.
Figure 6:
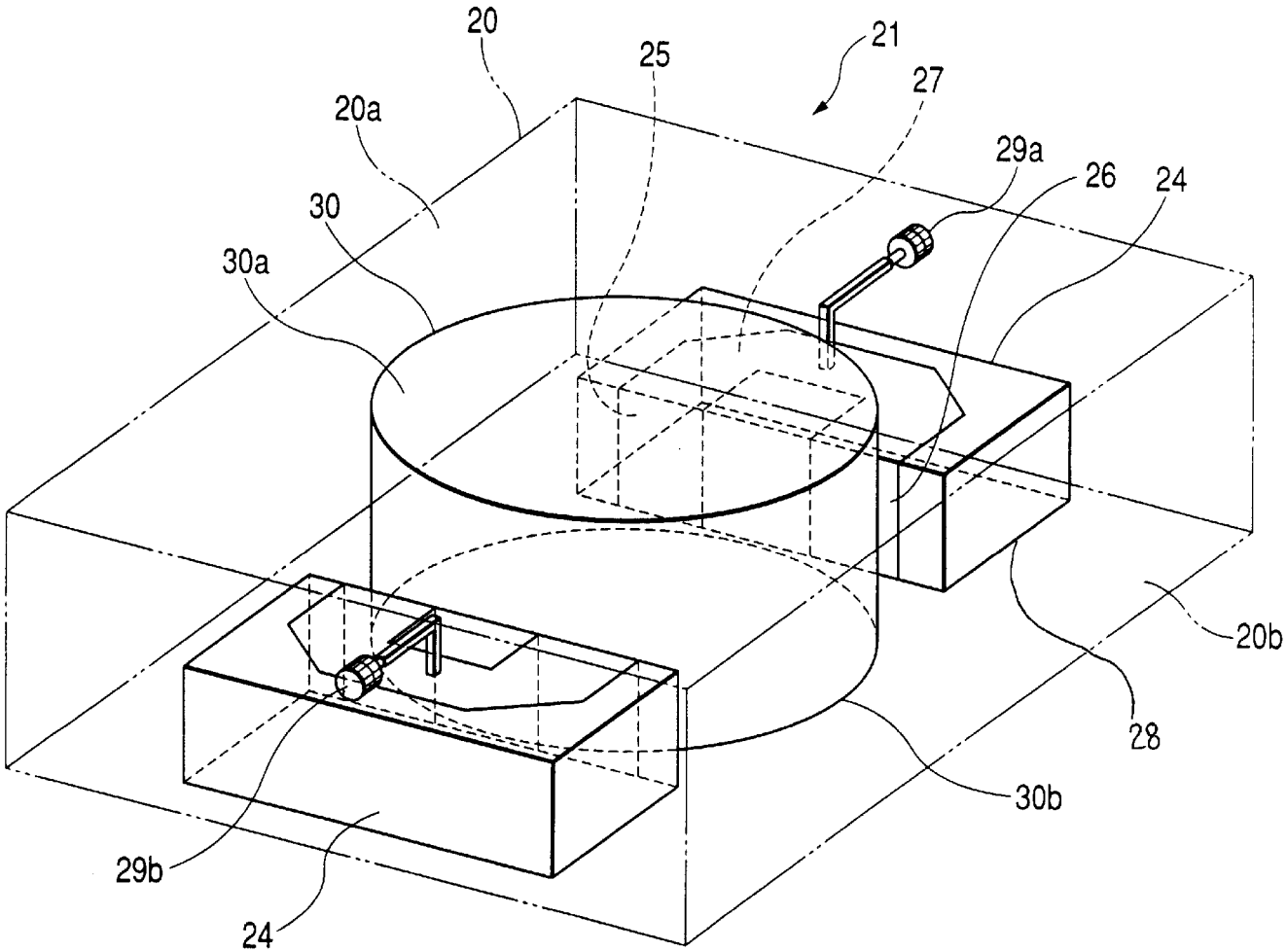
FIG. 6 is a perspective view of the dielectric resonator of the second embodiment of the invention.
Figure 7:
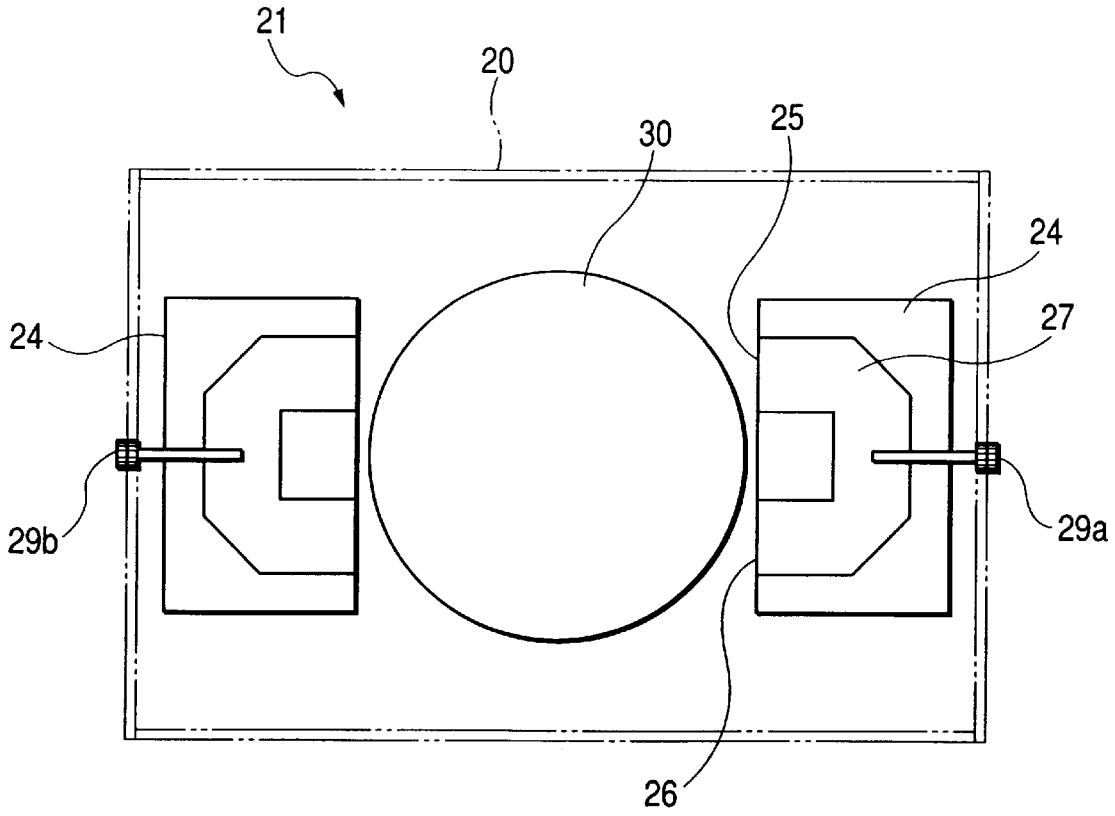
FIG. 7 is a plan view of the dielectric resonator of the second embodiment of the invention.

FIGS. 5 to 7 show a second embodiment of the dielectric resonator of the invention. FIGS. 5*a* nd 6 are perspective views and FIG. 7 is a plan view when seen from overhead.

Generally, a dielectric resonator 21 of the embodiment is constructed in such a manner that a dielectric block 30 and two supporting members 24 and 24 are housed in a casing 20.

Each of the supporting members 24 is made of dielectric ceramics similar to that of the first embodiment and formed in a prismatic shape. Two electrode bands 25 and 26 are spaced in parallel on one side face of each supporting member 24 and an almost U-shaped coupling band 27 is formed on the top face. Both ends of the coupling band 27 are continued from one ends on the same side of the two electrode bands 25 and 26. The electrode bands 25 and 26 and the coupling band 27 are made of a conductive material such as Cu or Ag and formed in a film state on the faces of the supporting member 24. A bottom face electrode 28 made of a similar conductive material is formed on the whole bottom face of the supporting member 24. The electrode bands 25 and 26, the coupling band 27, and the bottom face electrode 28 can be formed by plating, etching, sputtering, or the like in a manner similar to the electrode patterns 5, 6 and the bottom face electrode 7 in the first embodiment.

The electrode bands 25 and 26 on the side face of the supporting member 24 are positioned near the dielectric block 30 and so arranged as to be in parallel to the axial direction of the dielectric block 30. The bottom face of the supporting member 24 is fixedly bonded to the inner face of the bottomplate 20*b* of the casing 20 by using a cream solder or a conductive paste and the bottom face electrode 28 is connected to the ground.

An input terminal 29*a* or an output terminal 29*b* is connected to each of the coupling bands 27 and 27 of the two supporting members 24 and 24. The connection point of the input terminal 29*a* or the output terminal 29*b* and the coupling band 27 is preferably in the center of the path extending from one end to the other end of the coupling band 27.

In the dielectric resonator 21 having such a construction, exciting means is comprised of the supporting member 24, and the electrode bands 25 and 26, the coupling band 27, and the bottom face electrode 28 which are formed on the faces of the supporting member 24. More specifically, when an electric signal is supplied from the input terminal 29*a*, a current is passed via the coupling band 27 through the two electrodes 25 and 26 which are in parallel and a magnetic field is produced on the plane which perpendicularly crosses the axial direction of the dielectric block 30. By the magnetic energy, the dielectric block 30 is excited, the current flows through the dielectric block 30 and the conductive casing 20, and a magnetic field is generated. By the magnetic energy, a magnetic field is produced by the exciting means on the output side, a current is passed through each of the two electrodes 25 and 26, and an electric signal is outputted from the output terminal 29*b*.

The two electrode bands 25 and 26 and the coupling band 27 can be also considered as a continuous distributed constant line. Both ends of the line are connected to the ground and a feeding point is located at about the midpoint of the line, so that the bands are regarded as two distributed constant lines which are connected in parallel between the feeding point and the ground. In the embodiment, the resonance frequency changes according to the length of the two distributed constant lines connected in parallel between the feeding point and the ground, that is, the lengths of the electrode bands 25 and 26 and the length of the coupling band 27. When the distributed constant line having one end connected to the ground is seen from the other end, a parallel resonance circuit is made.

In the dielectric resonator 21 of the embodiment, the exciting means is comprised of the block-shaped supporting member 24, and the electrode bands 25 and 26, the coupling band 27, and the bottom face electrode 28 which are formed on the faces of the supporting member. Since the supporting members 24 are fixedly adhered in the conductive casing 20, the dielectric resonator 21 is not easily influenced by vibration, so that excellent performance can be stably obtained.

Since the exciting means is obtained by forming the electrodes on the supporting member 24 made of a material having a high dielectric constant, the physical dimension of the exciting means can be reduced by shortening the wavelength of the dielectric. Since the exciting means is used at about the resonance frequency, a large magnetic field can be produced. Further, since two electrodes (electrode bands 25 and 26) which can generate magnetic fields near the dielectric block 30 are provided, a magnetic field to be produced becomes strong.

Figure 8:
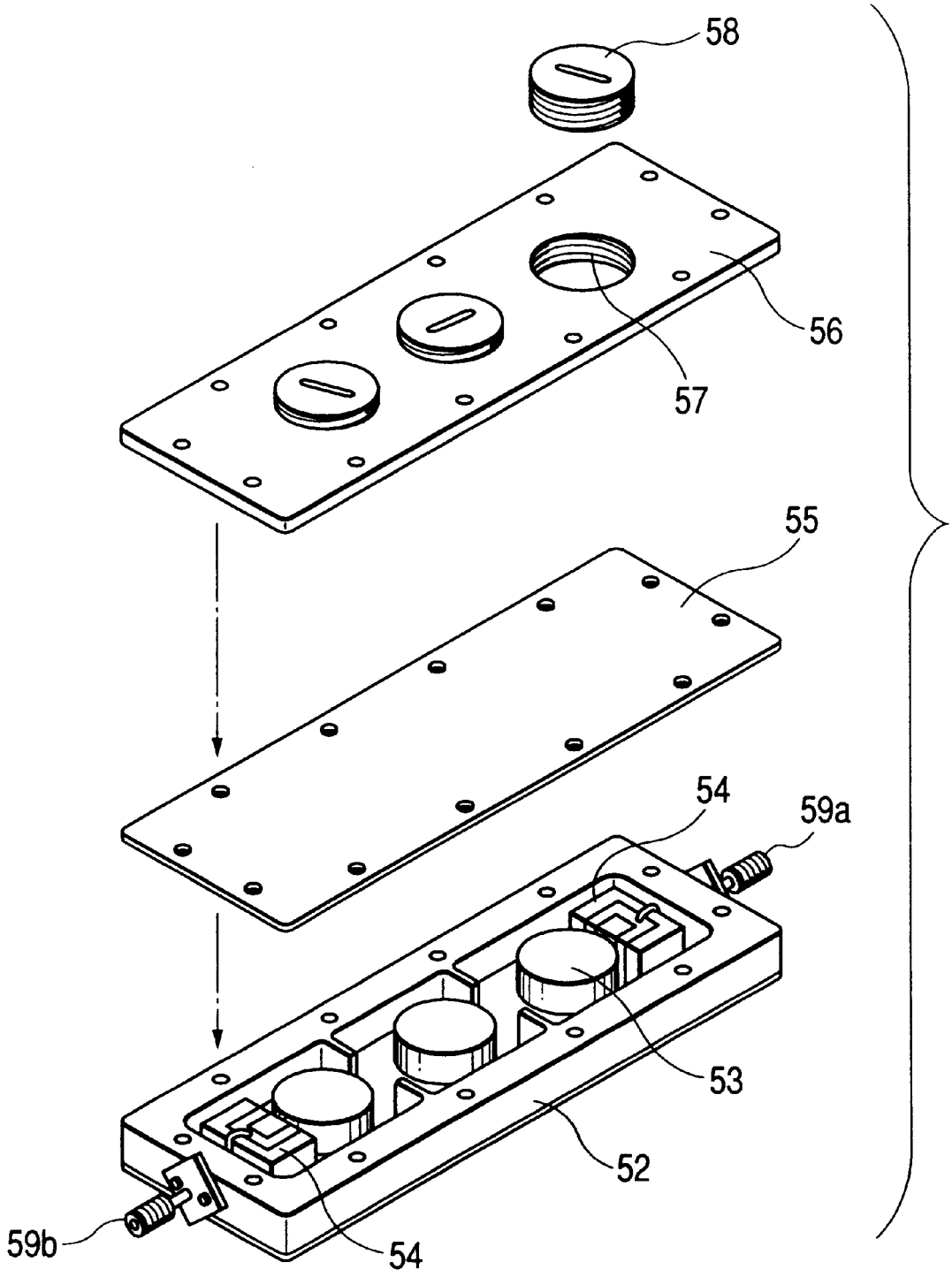
FIG. 8 is an exploded perspective view showing an example of a dielectric filter of the invention.
Figure 9:
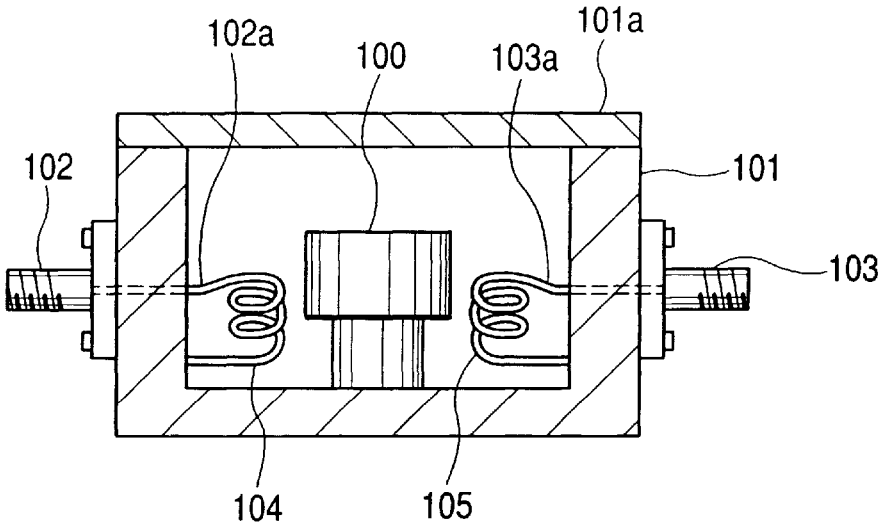
FIG. 9 PRIOR ART
FIG. 9 is a cross section showing an example of a conventional dielectric resonator.
Figure 10:
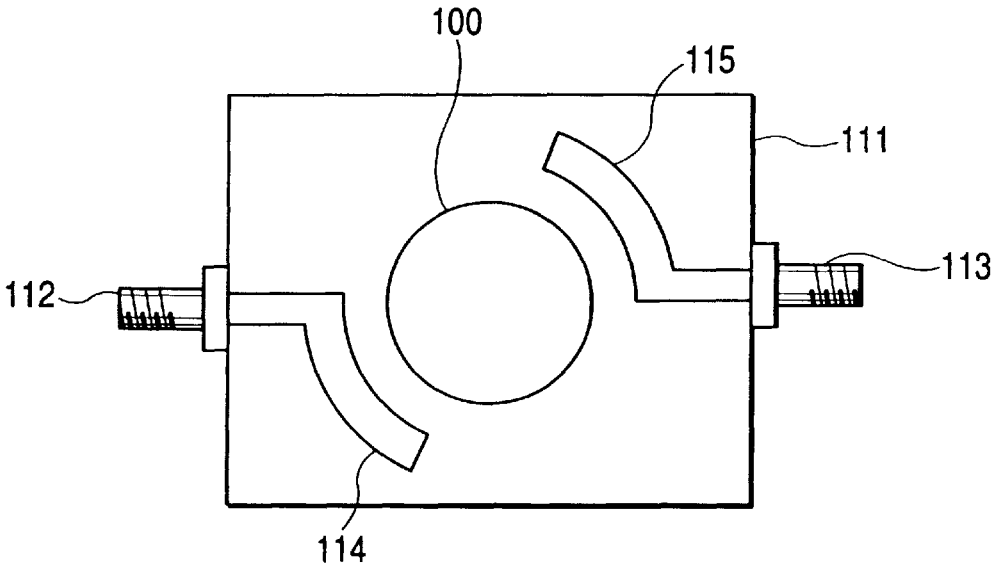
FIG. 10 PRIOR ART
FIG. 10 is a plan view showing another example of a conventional dielectric resonator.

The dielectric resonator 21 of the embodiment can be used as an input/output unit of a dielectric filter. FIG. 8 shows an example of the construction of the dielectric filter in which the dielectric resonators 21 of the embodiment are used as input and output units. In the dielectric filter of the example, three dielectric blocks 53 are arranged so as to be electromagnetically connected to each other in a conductive casing 52, and exciting means 54 and 54 each comprising the supporting member 24, and the electrode bands 25 and 26, the coupling band 27, and the bottom face electrode 28 which are formed on the faces of the supporting member 24 are provided at both ends. An input terminal 59*a* or an output terminal 59*b* is connected to each of the coupling bands 27 and 27 of the exciting means 54 and 54. Further, a leaf spring 55 is so placed as to cover the top face of the conductive casing 52. In a state where the leaf spring 55 is placed, the top face of the dielectric block 53 is projected from the periphery of the leaf spring 55 against the resilience of the leaf spring 55, so that the upper end electrode formed on the top face of the dielectric block 53 and the bottom face of the leaf spring 55 surely come into contact with each other. A lid member 56 is placed on the leaf spring 55, and the lid member 56 and the leaf spring 55 resecured to the conductive casing 52 by screws. Three screw holes 57 each having a relatively large diameter are opened in the lid member 56 on the central line in the longitudinal direction. By screwing disc-shaped cap screws 58 into the screw holes 57, the bottom faces of the cap screws 58 press the leaf spring 55 downward and the bottom face of the leaf spring 55 is pressed against the top face of the dielectric block 53.

Since the exciting means 54 and 54 each comprising the supporting member 24 and the electrode bands 25 and 26, the coupling band 27, and the bottom face electrode 28 which are formed on the faces of the supporting member 24 are provided as input and output units, the dielectric filter having such a construction becomes a vibration-resistant band-pass filter.

Although two parallel lines are formed by the electrode bands 25 and 26 between the input terminal in the coupling band 27 and the bottom face electrode 28 in the embodiment, it is also operable by a construction such that the input terminal and the bottom face electrode 28 are connected via a single line.

As a construction using no bottom face electrode 28, the ends of the electrode band 25 can be made open.

As another embodiment (not shown), arrangement such that a linear coupling band is formed on the top face of a prismatic supporting member and two electrode bands are formed continuously from both ends of the coupling band on the opposite side faces can be also employed. Preferably, two electrode bands 45 and 46 are formed along the direction connecting the top and down faces of a supporting member 44. Preferably, a bottom face electrode made of a conductive material is formed on the whole bottom face of the supporting member.

The supporting member having such a construction is disposed so that the electrode band on one of the side faces is positioned near the dielectric block and the electrode bands on the side faces are in parallel to the axial direction of the dielectric block. The bottom face of the supporting member is fixedly adhered to the inner face of the bottom plate of the casing and the bottom face electrode is connected to the ground. An input terminal or an output terminal is connected to the coupling band on the top face of each of the two supporting members. The connecting position of the input or output terminal is preferably the center of the coupling band.

In the dielectric resonator having such a construction, the exciting means is comprised of the supporting members, and the electrode bands, the coupling band and the bottom face electrode which are formed on the faces of each of the supporting members. When an electric signal is inputted from the input terminal, a current is passed through the electrode band located near the dielectric block via the coupling band, and a magnetic field is produced on the plane which perpendicularly crosses the axial direction of the dielectric block. The dielectric block is excited by the magnetic energy, the current is passed through the dielectric block and the conductive casing, and a magnetic field is generated. A magnetic field is produced by the exciting means on the output side by the magnetic energy, a current is passed through the electrode bands, and the electric signal is outputted from the output terminal. The resonance frequency changes according to the lengths of the electrode bands and the coupling band.

In the dielectric resonator of the embodiment, the exciting means is comprised of the block-shaped supporting members, and the electrode bands, the coupling band, and the bottom face electrode which are formed on the faces of each of the supporting member. Since the supporting members are fixedly bonded inside the conductive casing, the resonator is not easily influenced by vibration, so that excellent performance can be stably obtained.

Since the exciting means is obtained by forming the electrodes on the supporting member made of a material having a high dielectric constant, the physical dimension of the exciting means can be reduced by shortening the wavelength of the dielectric. Since the exciting means is used at about the resonance frequency, a large magnetic field can be produced.

The dielectric resonators of the embodiment can be used as input and output units of the dielectric filter. That is, it is sufficient to arrange a plurality of dielectric blocks so as to be electromagnetically connected to each other in a conductive casing and provide exciting means each comprising the supporting member, and the electrode bands, the coupling band, and the bottom face electrode which are formed on the faces of the supporting member at both ends. The dielectric filter obtained in such a manner becomes a vibration-resistant band-pass filter.

In the embodiment, as a construction having no bottom face electrode, ends of the electrode band can be made open.

Although two supporting members are arranged symmetrically with respect to the dielectric block in the dielectric resonator of the embodiment, the invention is not limited to the arrangement. It is sufficient to dispose the supporting members so that a magnetic field is produced on the plane which perpendicularly crosses the axial direction of the dielectric block when a current is passed through the electrode bands formed on the side faces. That is, the supporting members can be arranged so that the length direction of the top and bottom faces is the same as the direction of radius of the top and bottom faces of the dielectric block. The supporting members have to keep a distance from each other to prevent the magnetic fields generating around them from cancelling each other out.

Although the dielectric block is formed in a cylindrical shape in the foregoing embodiments of the invention, it can be also formed in a prismatic shape.

As described above, the dielectric resonator of the invention comprises the exciting means in which the pillar-shaped dielectric block is housed in a conductive casing in an electrically connected state and which produces a magnetic field on the plane which perpendicularly crosses the axial direction of the dielectric block through which a current is passed. The exciting means is constructed by the supporting members fixed to the casing, and at least one electrode pattern which is connected to an input or output terminal and is formed on the supporting member. With the construction, since the exciting means is fixed to the casing, the dielectric resonator which is not easily influenced by vibration and has very stably performance can be realized.

What is claimed is:

1. A dielectric resonator comprising exciting means in which a pillar-shaped dielectric block is housed in a conductive casing in a state where the dielectric block is electrically connected to the casing and which produces a magnetic field on a plane which perpendicularly crosses the axial direction of the dielectric block through which a current is passed, wherein the exciting means has a supporting member which is fixed to the casing and at least one electrode which is connected to an input or output terminal and formed on the supporting member, wherein the supporting member is made of a dielectric, the electrode pattern is comprised of two electrode patterns sandwiching the supporting member, one of the electrode patterns is connected to either an input terminal or an output terminal, and the other electrode pattern is connected to the ground.

2. The dielectric resonator according to claim 1, wherein the two electrode patterns have opposed parts over the supporting member.

3. A dielectric resonator comprising exciting means in which a pillar-shaped dielectric block is housed in a conductive casing in a state where the dielectric block is electrically connected to the casing and which produces a magnetic field on a plane which perpendicularly crosses the axial direction of the dielectric block through which a current is passed, wherein the exciting means has a supporting member which is fixed to the casing and at least one electrode which is connected to an input or output terminal and formed on the supporting member, wherein the supporting member is made of a dielectric, the electrode pattern is comprised of two electrode bands which are spaced in parallel and coupling band which couples one ends on the same side of the two electrode bands, and either the input terminal or the output terminal is connected to the electrode pattern.

4. The dielectric filter according to claim 1 further comprising a dielectric resonator.

5. The dielectric filter according to claim 3 further comprising a dielectric resonator.

* * * * *